US007150274B2

(12) United States Patent
Iwami et al.

(10) Patent No.: US 7,150,274 B2
(45) Date of Patent: Dec. 19, 2006

(54) IGNITION DEVICE FOR INTERNAL COMBUSTION ENGINE

(75) Inventors: Atsushi Iwami, Susono (JP); Tetsuya Miwa, Nagoya (JP); Hiromi Hiramatsu, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/138,442

(22) Filed: May 27, 2005

(65) Prior Publication Data

US 2005/0263145 A1 Dec. 1, 2005

(30) Foreign Application Priority Data

May 27, 2004 (JP) ..... 2004-157662
Feb. 24, 2005 (JP) ..... 2005-049745

(51) Int. Cl.
*F02P 3/02* (2006.01)
*H01F 27/02* (2006.01)

(52) U.S. Cl. ..... 123/635

(58) Field of Classification Search ..... 123/634, 123/635, 647
See application file for complete search history.

(56) References Cited

U.S. PATENT DOCUMENTS 6,675,785 B1 * 1/2004 Miwa et al. ..... 123/635
6,694,958 B1 * 2/2004 Hiramatsu et al. ..... 123/634
6,698,411 B1 * 3/2004 Maekawa et al. ..... 123/635
6,817,350 B1 * 11/2004 Miwa et al. ..... 123/634
6,880,540 B1 * 4/2005 Fuma et al. ..... 123/634
6,966,311 B1 * 11/2005 Hiramatsu et al. ..... 123/634
7,017,566 B1 * 3/2006 Miwa et al. ..... 123/634
7,080,638 B1 * 7/2006 Mizutani et al. ..... 123/635
2005/0284454 A1 * 12/2005 Iwami et al. ..... 123/635

FOREIGN PATENT DOCUMENTS

JP 08-144916 6/1996
JP 2003-028039 1/2003

* cited by examiner

*Primary Examiner*—Hai Huynh
(74) *Attorney, Agent, or Firm*—Nixon & Vanderhye PC

(57) ABSTRACT

An ignition device for an internal combustion engine has a primary and secondary coils of an ignition coil, a center and ground electrodes of a spark plug, a cylinder shaped insulator and a cylinder shaped tube. The center electrode is disposed apart from the secondary coil in a longitudinal direction of the ignition device. The insulator is made of an insulating material and has a coil surrounding portion surrounding the secondary coil and a plug surrounding portion surrounding the center electrode. The primary coil is wound on an outer circumferential face of the coil surrounding portion. The ground electrode is disposed on an outer circumferential face of the plug surrounding portion. The tube is made of a magnetic material and has a coil covering portion covering the primary coil and a plug covering portion covering the plug surrounding portion and the ground electrode.

11 Claims, 5 Drawing Sheets

IGNITION DEVICE FOR INTERNAL COMBUSTION ENGINE

CROSS REFERENCE TO RELATED APPLICATION

This application is based on Japanese Patent Applications No. 2004-157662 filed on May 27, 2004 and No. 2005-049745 filed on Feb. 24, 2005, the contents of which is incorporated herein by reference.

FIELD OF THE INVENTION

The present invention relates to an ignition device for an internal combustion engine combining a spark plug and an ignition coil, especially relates to the ignition device having a relatively small diameter of the ignition coil.

BACKGROUND OF THE INVENTION

An ignition coil for an internal combustion engine has a coil portion disposed at a middle portion, a control portion disposed at an upper end portion and a high voltage tower portion disposed at a lower end portion in a longitudinal direction thereof. The control portion includes an igniter for interrupting a current through a primary coil in the coil portion to generate a large voltage in a secondary coil in the coil portion. The large voltage is transmitted via the high voltage tower portion having cables and the like to a spark plug. Some ignition coil has a structure directly connected to the spark plug without cables and the like.

As shown in FIG. 7, a conventional ignition coil 100 as disclosed in JP-2003-28039-A has a primary coil 101, a secondary coil 102 and a connector portion 103 at a bottom side of the primary and secondary coils 101, 102. A spark plug 105 has an electrical insulating connector portion 106 at a top end portion thereof. The connector portion 103 of the ignition coil 100 and the connector portion 106 of the spark plug 105 are connected to each other to be enclosed in a plug pipe 107. The ignition device disclosed in JP-2003-28039-A, however, has a complicated structure having relatively many components and requiring much assembling works.

As shown in FIG. 6, a configuration can be thought to solve the above-described issue to dispose components of the ignition coil 85 and the spark plug 86 in a cylinder-shaped insulator 88. In an ignition device shown in FIG. 6, a center core 91, a secondary spool 92 and a secondary coil 93 are enclosed in a center bore formed in a large diameter portion 89*a*, an upper half portion of the insulator 88. A primary coil 94 is wound on an outer circumferential face of the large diameter portion 89*a*. A center electrode 96 is disposed in a center bore formed in a small diameter portion 89*b*, a lower half portion of the insulator 88. Further, a thin cylinder-shaped case 97 is disposed around the insulator 88. The case 97 is made of magnetic material. Still further, a thin cylinder-shaped tube 98 is disposed around the case 97 to form a clearance 99 therebetween. The tube 98 is made of electrical insulating material.

The tube 98 serves as a partition to prevent lubricating oil in an intake/exhaust valve assembly (not shown) disposed by a side of the coil portion 85 from entering in the coil portion 85 and the spark plug 96. The intake/exhaust valve assembly includes an intake valve, an exhaust valve and valve moving mechanism for the intake and exhaust valves. The valve moving mechanism includes a cam and a rocker arm oscillated by the cam to move the intake valve and the exhaust valve. The lubricating oil is supplied to a contact portion between the cam and the rocker arm. The tube 98 prevents the lubricating oil from flowing along the ignition device to the plug portion 96. If the cam is in a direct contact with the intake and exhaust valves and the like not via the rocker arm, the lubricating oil is supplied to a contact portion between the cam and the intake and exhaust valves and the like.

The ignition device shown in FIG. 6, however, still has an issue that an outer diameter of the ignition coil 85 is large.

Firstly, the case 97 and the tube 98 make the outer diameter of the ignition coil 85 large. The case 97 made of magnetic material is disposed radially outside the center core 91, the secondary winding 93, the primary winding 94 and so on and serves a peripheral core of the ignition coil 85 that is indispensable as a component of the ignition coil 85. The tube made of electrical insulating material is inserted in a top end portion of the plug hole and is indispensable to prevent the lubricating oil from entering in the spark plug. The case 97 and the tube 98 separately formed from the case 97, however, make the outer diameter of the ignition coil 85 large.

Secondly, a cylindrically shaped clearance 99 between the case 97 and the tube 98 makes the outer diameter of the ignition coil 85 large. The clearance 99 is necessary for installing the ignition device in the plug hole of the internal combustion engine.

Currently, internal combustion engines are manufactured in small dimensions, so that the ignition plug and the spark plug are disposed close to the valve moving mechanism having a complex structure on a relatively small area on the cylinder head. Thus, it is required to reduce the outer diameters of the ignition plug and the spark plug. Especially, it is required to reduce a thickness of the tube 98 and that of the clearance 99, which are provided for preventing lubricating oil from entering in the ignition coil and the spark plug and have no principal function of the ignition coil and the spark plug.

SUMMARY OF THE INVENTION

The present invention, in view of the above-described issue, has an object to provide an ignition device for an internal combustion engine combining a spark plug and an ignition coil and having a relatively small diameter of the ignition coil.

The ignition device for an internal combustion engine has a primary and secondary coils of an ignition coil, a center and ground electrodes of a spark plug, a cylinder shaped insulator and a cylinder shaped tube. The center electrode is disposed apart from the secondary coil in a longitudinal direction of the ignition device. The insulator is made of an insulating material and has a coil surrounding portion surrounding the secondary coil and a plug surrounding portion surrounding the center electrode. The primary coil is wound on an outer circumferential face of the coil surrounding portion. The ground electrode is disposed on an outer circumferential face of the plug surrounding portion. The tube is made of a magnetic material and has a coil covering portion covering the primary coil and a plug covering portion covering the plug surrounding portion and the ground electrode.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
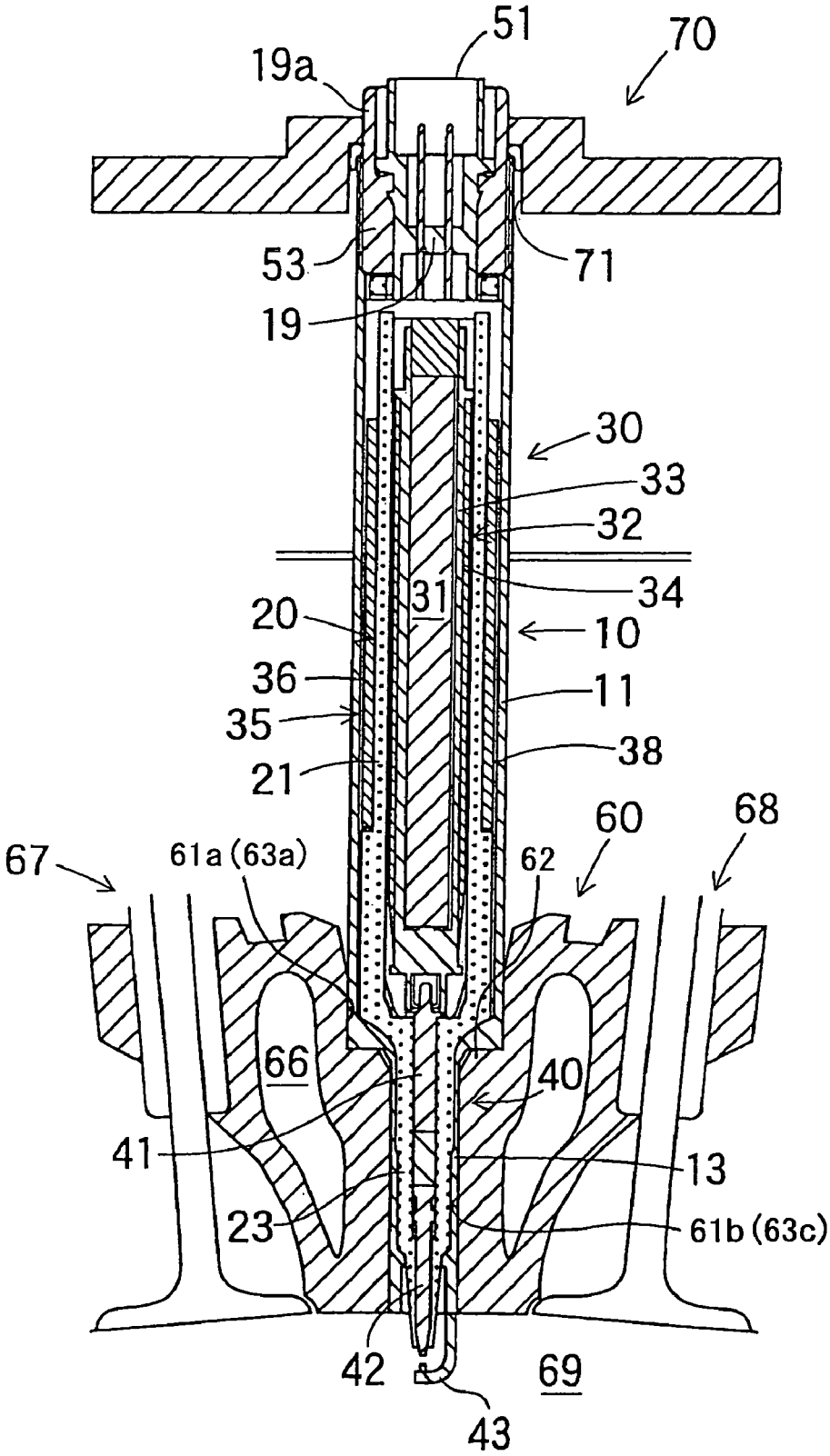
FIG. 1 is a cross-sectional view showing an ignition device for an internal combustion engine according to an embodiment of the present invention.

As shown in FIG. 1, an ignition device according to an embodiment of the present invention is mounted between a cylinder head 60 and a head cover 70 of an internal combustion engine together with an intake/exhaust valve assembly 67, 68 and so on. Specifically, the cylinder head 60 and the head cover 70 each have plug hole 61, 71 and a valve mounting hole (not shown) communicated to a combustion chamber 69 of the internal combustion engine to mount the ignition device and the intake/exhaust valve assembly therein.

An annular shaped water jacket 66 is formed around the plug hole 71 to circulate coolant therethrough. The intake/exhaust valve assembly 67, 68 is driven by a rocker arm (not shown), which is actuated by a cam. Lubricating oil is supplied to a slide contact portion between the rocker arm and the cam to open and close the intake/exhaust valve assembly 67, 68 smoothly.

The plug hole 61 of the cylinder head 60 includes a large diameter bore 61*a* and a small diameter bore 61*b* having round cross-sections and respectively disposed at an upper portion and a lower portion thereof. The large and small diameter bores 61*a*, 61*b* form an approximately annular shaped seat portion 62 therebetween on which an annular shaped mounting portion 16 of the ignition device seats so that a plug covering portion 13 of the ignition device is inserted in and press-fitted in the small diameter bore 61*b*. The small diameter bore 61*b* is longer than the large diameter bore 61*a* in a longitudinal direction of the plug hole 61.

The ignition device includes an ignition coil 30 and a spark plug 40 that have round cross-sections are disposed in a longitudinal direction of the ignition device. Specifically, the ignition device has a thin cylinder-shaped tube 10 and a thin cylinder-shaped insulator 20 in which the ignition coil 30 and the spark plug 40 are integrally disposed. The tube 10 is made of magnetic material. The insulator 20 is made of electrical insulating material such as ceramics and the like.

Figure 2:
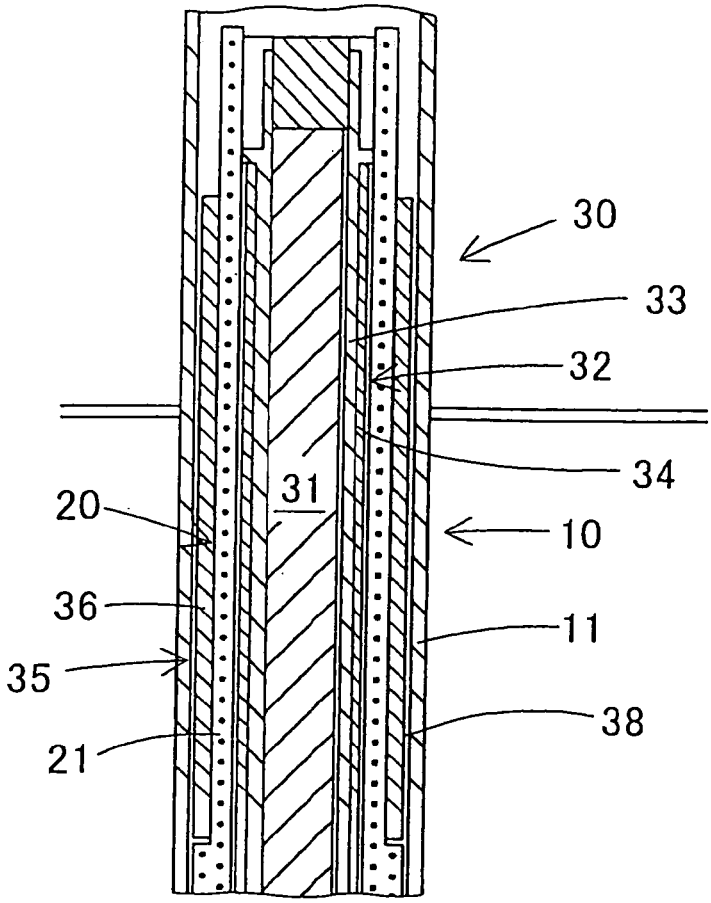
FIG. 2 is an enlarged cross-sectional view showing a principal portion of the ignition device according to the embodiment.

As shown in FIGS. 1 and 2, The ignition coil 30 includes a center core 31, a secondary coil 32, a primary coil 35, an insulating layer 38 and a coil covering portion 11 of the tube 10 that are disposed in an order as listed above from inside to outside in a radial direction thereof.

The secondary coil 32 includes an electric insulating secondary spool 33 having a blind-ended cylindrical shape and a secondary winding 34 wound on an outer circumferential face of the secondary spool 33. The primary coil 31 includes a primary winding 36 wound on a (coil cover portion) 21 provided at an upper half of the insulator 20.

The primary coil 35 includes a coil surrounding portion 21, which is an upper portion of the insulator 20, and a primary winding 36 wound on a depression formed on an outer circumferential face of the coil surrounding portion 21. That is, the coil surrounding portion 21 serves a primary spool for the primary winding 36. The coil surrounding portion 21 is disposed in a proximity to an outer circumferential face of the primary winding 36 and/or an inner circumferential face of the coil covering portion 11. Both ends of the primary winding 36 extend upward and are connected via a connector 51 to a battery and an igniter (not shown).

The insulating layer 38 is made of electrical insulating resin such as epoxy resin and has a thin cylindrical shape. The insulating layer 38 is attached on an outer circumferential face of the primary winding 36. The insulating layer 38 is longer than the primary winding 36 in the longitudinal direction of the ignition device to cover an entire outer circumferential face of the coil surrounding portion 21.

The coil covering portion 11 is an upper portion of the tube 10. The coil covering portion 11 serves both a peripheral core of the ignition coil 30. The coil covering portion 11 also servers a partition between the ignition coil 30 and a intake/exhaust valve assembly (not shown) disposed by a side of the ignition device to prevent the lubricating oil in the intake/exhaust valve assembly from entering in the ignition coil 30 and the spark plug 40 of the ignition device. The coil covering portion 11 and the insulating layer 38 does not form a substantial gap therebetween and are in proximity to or in a tight contact with each other. The coil covering portion 11 has a thickness not less than 0.4 mm.

As shown in FIG. 1, the spark plug 40 includes a stem 41, a center electrode 42, a plug surrounding portion 23, which is a lower portion of the insulator 20 and disposed around the center electrode 42, a ground electrode 43 and a plug covering portion 13, which is a lower portion of the tube 10.

The center electrode 42 is connected to the stem 41, which is connected to a high voltage end of the secondary winding 34 of the ignition coil 30.

Figure 3:
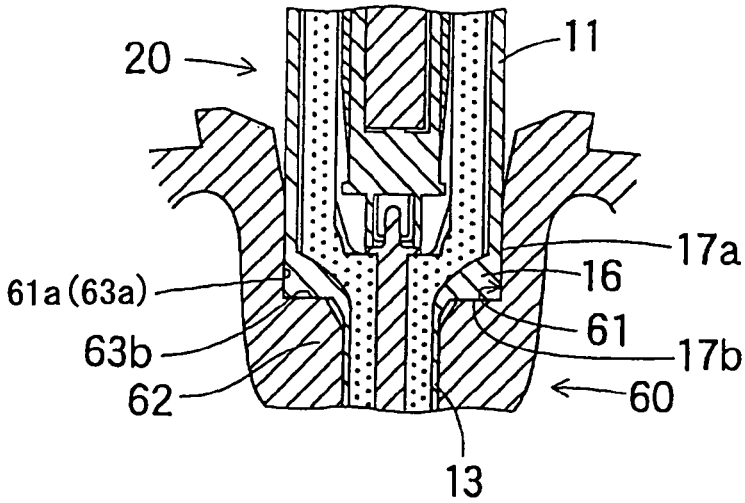
FIG. 3 is an enlarged cross-sectional view showing another principal portion of the ignition device according to the embodiment.

The plug surrounding portion 23 surrounds the center electrode 42 and the ground electrode 43. As shown in FIG. 3, a diameter of the plug surrounding portion 23 is smaller than a diameter of the coil surrounding portion 21 of the ignition coil 30. A length of the plug surrounding portion 23 is smaller than a length of the coil surrounding portion 21 in the longitudinal direction of the insulator 20. The plug surrounding portion 23 is integrally formed with the coil surrounding portion 21.

The tube 10 is shaped in accordance with a shape of the insulator 20. That is, a diameter of the plug covering portion 13 is smaller than a diameter of the coil covering portion 11 to form the mounting portion 16 therebetween. A length of the coil covering portion 11 is larger than a length of the plug covering portion 13 in the longitudinal direction of the ignition device. The mounting portion 16 has an outer circumferential face 17*a* in parallel to a longitudinal direc tion and an annular shaped bottom face 17*b* extending in a radial direction of the tube 10.

The plug covering portion 13 of the tube 10 is press-fitted in the small diameter bore 61*b* of the plug hole 61 to expose a tip (lower end) of the grounding electrode 43 in the combustion chamber 69. The coil covering portion 11 of the ignition coil 30 is press-fitted in the plug hole 61 to prevent the lubricating oil from entering in a space around the spark plug 40 together with the plug covering portion 13.

The above-described seat portion 62 of the insertion hole 61 has an inner circumferential face 63*a* and a top face 63*b*. An inner diameter of the inner circumferential face 63*a* (a diameter of the large diameter bore 61*a*) and an outer diameter of the outer circumferential face 17*a* are approximately equal to each other.

To assemble the ignition device according to the embodiment, the secondary coil 32, the stem 41, the center electrode 42, etc. are installed in the insulator 20. Then, the primary winding 36 is wound on the coil surrounding portion 21 of the insulator 20 and the insulating layer 38 is putted thereon. Next, the secondary coil 32, the primary coil 35, etc. assembled as described above are installed in the tube 10.

Further, a bolt 53 is inserted in an annular space between the coil covering portion 11 of the tube 10 and a center member 19. A male screw portion of the bolt 53 is screw-fastened to a female screw portion provided on the outer circumferential face of the coil covering portion 11. The bolt 53 blocks a top opening of the ignition device in a state that the tube 10 encloses a center core 31, the secondary coil 32, the center electrode 42, the primary coil 35 and the insulator 20 therein. An annular portion 19*a* of the center member 19 is press-fitted in the plug hole 71 of the head cover 70.

The ignition device according to the embodiment operates as follows.

The coil covering portion 11 of the tube 10 radially outside the center core 31 is made of magnetic material to serve the peripheral core of the ignition coil 30. Thus, magnetic flux generated by the primary coil 36 passes through the center core 31 and the coil covering portion 11. Accordingly, the center core 31, the secondary coil 32, the primary coil 35 and the coil covering portion 11 form an open magnetic circuit.

When current flowing through the primary coil 35 is interrupted by the igniter at timing with regard to an operation of the intake/exhaust valve assembly 67, 68, the secondary coil 32 accumulates a large voltage current. The large voltage current is supplied to the spark plug 40 to discharge between the center core 42 and the ground electrode 43 and ignite air-fuel mixture in the combustion chamber 69.

The ignition device according to the embodiment has the following advantages.

First, the ignition device can be manufactured so that the ignition coil 30 has a small outer diameter. This is realized by the tube 10 made of magnetic material to serve both as the partition between the ignition coil 30 and the intake/exhaust valve assembly and the peripheral core of the ignition coil 30. Thus, it is necessary to provide the ignition coil with a peripheral core other than the tube 10. Further, the insulator 20 and the tube 10 interpose only the insulating layer 38 therebetween, so that the coil cover portion 11 and the insulating layer 38 are disposed in proximity to or in a tight contact with each other. Accordingly, the outer diameter of the ignition coil 30 can be equal to 18 mm or smaller.

Secondly, the coil covering portion 11 and the plug covering portion 13 of the tube 10 prevents the lubricating oil from entering in the spark plug 40. This is realized by disposing the coil covering portion 11 between the ignition coil 30 and the intake/exhaust valve assembly 67, 68 and press-fitting the plug covering portion 13 to the cylinder head 60. That is, the mounting portion 16 is press-fitted in the plug hole 61 so that the outer circumferential face 17*a* and the bottom face 17*b* respectively come in a tight contact with an inner circumferential face 63*a* and the top face 63*b* of the seat portion 62.

Modified Embodiments (1) First Modified Embodiment

Figure 4:
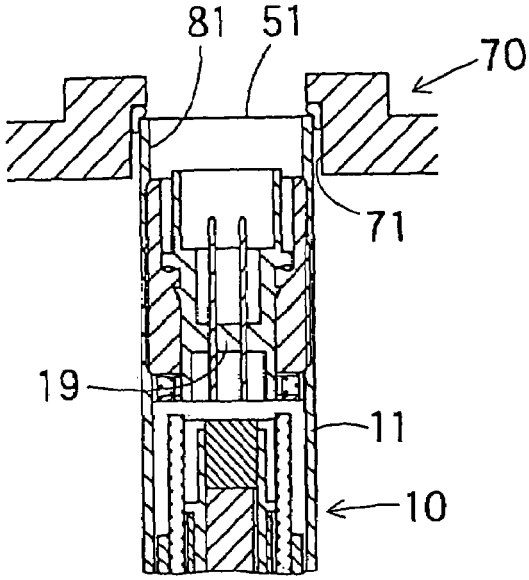
FIG. 4 is a cross-sectional view showing a principal portion of an ignition device for an internal combustion engine according to a first modified embodiment of the present invention.

FIG. 4 depicts an ignition device according to a first modified embodiment of the present invention. The ignition device according to the first embodiment is press-fitted in the insertion hole 71 of the head cover 70 in a different manner relative to the above-described embodiment. A top end portion 81 of the coil covering portion 11 is extended beyond the center member 19 to be press-fitted in the plug hole 71 of the head cover 70 in such a case that the plug hole 61 of the cylinder head 60 and/or the plug hole 71 of the head cover 70 are long relative to those in the first embodiment.

(2) Second Modified Embodiment

Figure 5:
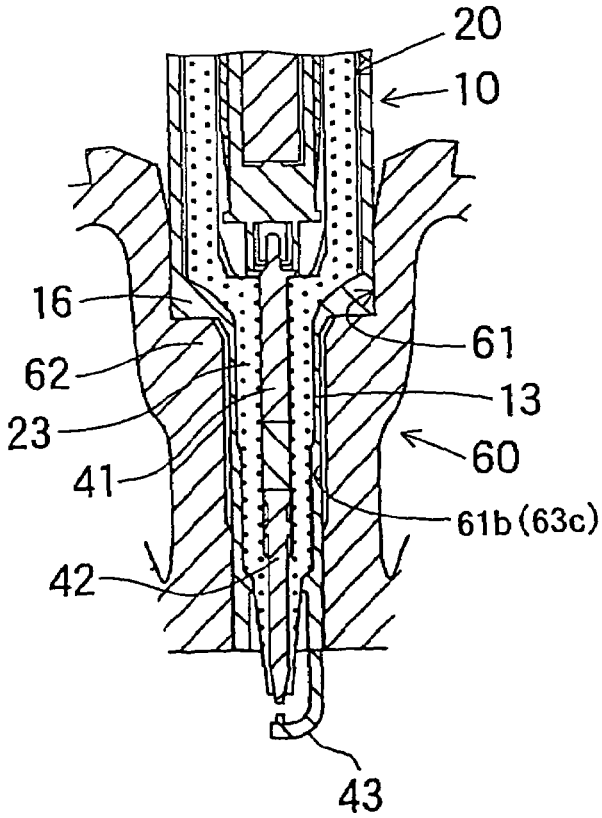
FIG. 5 is a cross-sectional view showing a principal portion of an ignition device for an internal combustion engine according to a second modified embodiment of the present invention.
Figure 6:
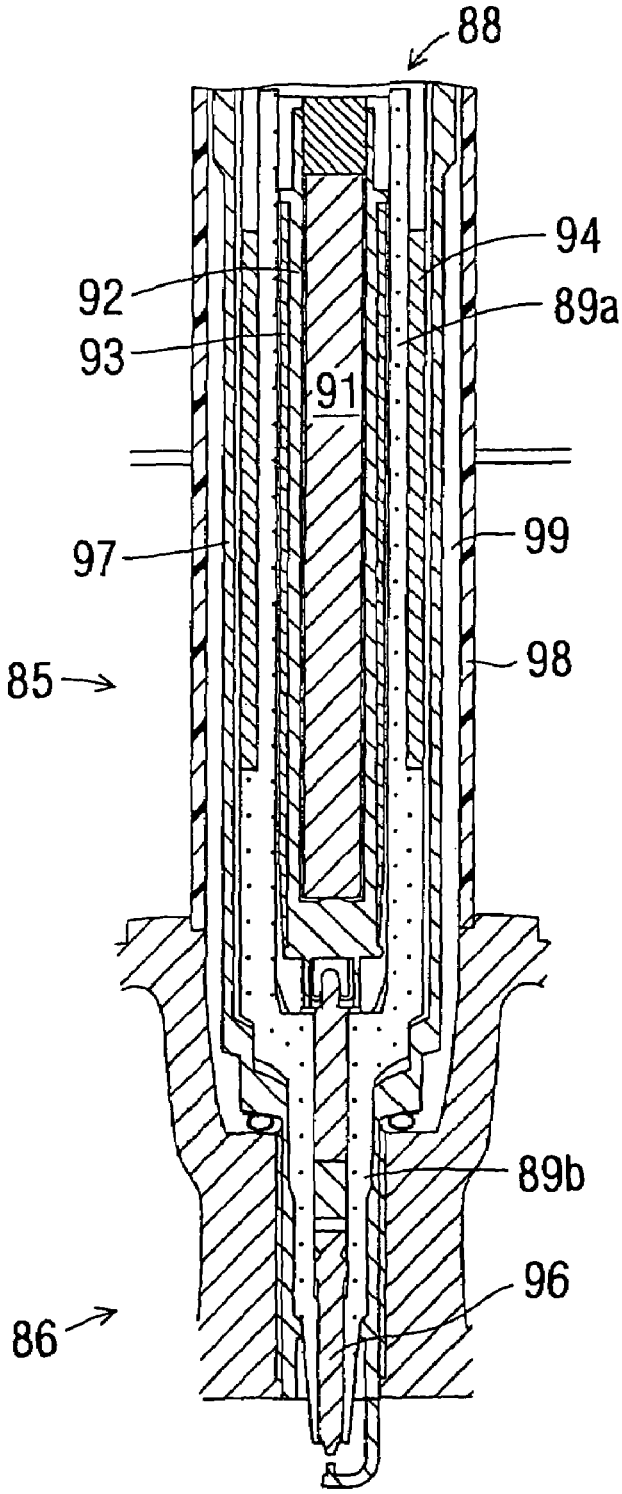
FIG. 6 RELATED ART
FIG. 6 is a cross-sectional view showing an ignition device for an internal combustion engine according to a related art.
Figure 7:
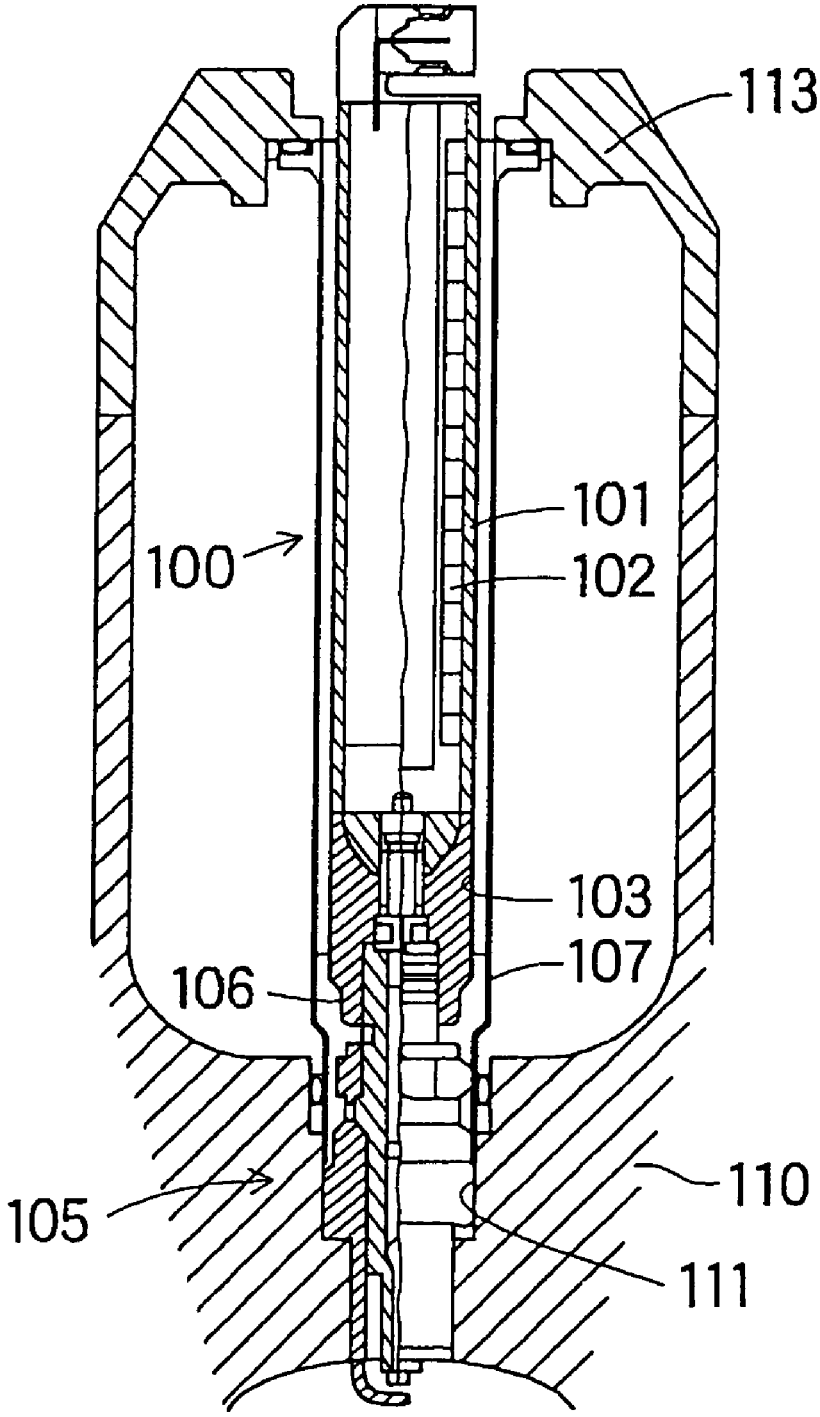
FIG. 7 PRIOR ART
FIG. 7 is a cross-sectional view showing a conventional ignition device for an internal combustion engine.

FIG. 5 depicts an ignition device according to a second modified embodiment of the present invention. The plug surrounding portion 23 and the plug covering portion 11 are respectively tapered off toward tips (lower ends) thereof. The plug covering portion 11 press-fitted in the small diameter bore 61*b* of the plug hole 61 comes in a securely tight contact with the small diameter bore 61*b*. The small diameter portion 63*a* may not be tapered off.

The ignition coils according to the first and second modified embodiment respectively have ignition coil 30 substantially as same as the above-described main embodiment and has advantages as those of the main embodiment.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ignition device to be installed to extend between a cylinder head and a head cover of an internal combustion engine, the ignition device combining an ignition coil and a spark plug and comprising:

a secondary coil of the ignition coil;

a center electrode of the spark plug disposed apart from the secondary coil in a longitudinal direction of the ignition device;

a cylinder shaped insulator made of an insulating material and having a coil surrounding portion surrounding the secondary coil and a plug surrounding portion surrounding the center electrode;

a primary coil of the ignition coil wound on an outer circumferential face of the coil surrounding portion;

a ground electrode of the spark plug disposed on an outer circumferential face of the plug surrounding portion; and a cylinder shaped tube made of a magnetic material and having a coil covering portion covering the primary coil and a plug covering portion covering the plug surrounding portion and the ground electrode, the coil covering portion and the plug covering portion being integrally formed in one piece, and an upper end portion of the coil covering portion being fitted to the head cover and the plug covering portion being press fitted in a plug hole of the cylinder head so that said coil covering portion and plug covering portion shield the ignition coil, the spark plug, and the insulator from lubricating oil in a space between the cylinder head and the head cover.

2. The ignition device according to claim 1, wherein the coil covering portion is a peripheral core of the ignition coil.

3. The ignition device according to claim 1, wherein the insulator is disposed close to at least one of an outer circumferential face of the primary coil and an inner circumferential face of the coil covering portion.

4. The ignition device according to claim 1, wherein the plug covering portion is tapered off toward a tip thereof.

5. The ignition device according to claim 1, wherein an upper end portion of the coil covering portion is press-fitted in an insertion hole provided on a head cover of the internal combustion engine.

6. The ignition device according to claim 1, wherein a diameter of the coil surrounding portion is larger than a diameter of the plug surrounding portion and a diameter of the coil covering portion is larger than a diameter of the plug covering portion.

7. The ignition coil according to claim 6, wherein:

the coil surrounding portion and the plug surrounding portion form an annular shaped mounting face therebetween to extend in a radial direction of the ignition device; and the spark plug is inserted in an insertion hole provided on a cylinder head so that the mounting face comes in tight contact with a mounting seat provided in the insertion hole.

8. The ignition device according to claim 1, wherein the coil covering portion seals outer circumferential faces of the ignition coil and the spark plug.

9. The ignition device according to claim 8, wherein the coil covering portion is a peripheral core of the ignition coil.

10. The ignition device according to claim 1, further comprising an insulating layer disposed between the primary coil and the coil covering portion.

11. The ignition device according to claim 10, wherein the insulating layer extends over an area in which the primary coil and the coil covering portion overlaps each other.

* * * * *